US006553986B1

(12) United States Patent
Liu

(10) Patent No.: US 6,553,986 B1
(45) Date of Patent: Apr. 29, 2003

(54) BURNER FOR A GAS BARBECUE GRILL

(76) Inventor: George C. M. Liu, No. 1-10, Hsing-Chung Rd., Tou-Nan Chen, Yunlin Hsien (TW)

( * ) Notice: Subject to any disclaimer, the term of this patent is extended or adjusted under 35 U.S.C. 154(b) by 0 days.

(21) Appl. No.: 10/115,185

(22) Filed: Apr. 1, 2002

(51) Int. Cl.[7] ..... F23Q 9/00
(52) U.S. Cl. ..... 126/41; 126/39; 431/278
(58) Field of Search ..... 126/41, 39, 44; 431/278, 11, 10

*Primary Examiner*—Henry Bennett
*Assistant Examiner*—Sabrina Dagostino

(74) *Attorney, Agent, or Firm*—Dellett & Walters

(57) ABSTRACT

A burner has a mixing tube, a side tube, an auxiliary tube and a fire bridge. The auxiliary tube with a diameter smaller than that of the mixing tube is mounted above the mixing tube and is connected to the control valve connected to the mixing tube. Multiple orifices are defined in the top of the auxiliary tube. The fire bridge is connected between the mixing tube and the auxiliary. Multiple orifices are defined in the top of the fire bridge. Accordingly, the flames can be switched between the side tube and the auxiliary tube. With a diameter of the auxiliary tube being small relative to the mixing tube, the flame on the auxiliary tube will not go out even when a small quantity of gas is led into the auxiliary tube. Consequently, the burner can provide a reliable low level heat function.

3 Claims, 6 Drawing Sheets

BURNER FOR A GAS BARBECUE GRILL

BACKGROUND OF THE INVENTION

1. Field of the Invention

The present invention relates to a burner, and more particularly to a burner for a gas barbecue grill and that has a reliable low level heat function and a wide range heat output performance.

2. Description of Related Art

With reference to FIG. 6, a burner (40) for a gas barbecue grill in accordance with the prior art comprises a mixing tube (42) and a side tube (44). The burner (40) is secured in the housing of the gas barbecue grill and is connected to a gas source with a control valve (50), such that the burner (40) can heat or cook food with a flame from burning gas. The mixing tube (42) is connected with the control valve (50) at one end of the mixing tube (42). The side tube (44) is U-shaped and is connected to the other end of the mixing tube (42) at the middle portion of the side tube (44). The side tube (44) communicates with the mixing tube (42) and has multiple orifices (442) defined in the top of the side tube (44). Accordingly, the gas can be led into the side tube (44) through a hose, the control valve (50) and the mixing tube (42) and is emitted from the orifices (442) in the side tube (44). After igniting the gas, flames will occur on the side tube (44) to heat or to cook the food.

In addition, an adjusting knob (52) is mounted on the control valve (40) to adjust the passage in the control valve (50) for the gas passing therethrough so as to control the flames on the burner (40). The user can control the flames to cook the food or keep warm to the food by means of turning the adjusting knob (52). However, when user only wants to keep warm to the food and the user lowers the intensity of the flames, the quantity of gas emitted from the control valve (50) and into the mixing tube (42) is not enough to evenly spread in the mixing tube (42) and the side tube (44) with large diameters. Therefore, the flames on the conventional burner easily go out because that the gas cannot be continuously applied for burning. The gas keeps emitting from the orifices (442) in the side tube (44) when the flames go out, thereby causing an extremely dangerous condition. The conventional burner (40) has not a good performance in a low level heat function, and the use of the conventional burner (40) is not versatile.

To overcome the shortcomings, the present invention tends to provide a burner to mitigate or obviate the aforementioned problems.

SUMMARY OF THE INVENTION

The main objective of the invention is to provide a burner for a gas barbecue grill and having a reliable low level heat function and a wide range heat output performance. The burner has a mixing tube, a side tube, an auxiliary tube and a fire bridge. The side tube is secured to one end of the mixing tube and communicates with the mixing tube. Multiple orifices are defined in the top of the side tube. The auxiliary tube with a diameter smaller than that of the mixing tube is mounted above the mixing tube and is connected to the control valve which is connected to the mixing tube. Multiple orifices are defined in the top of the auxiliary tube. Consequently, the gas can be controlled to be led into the mixing tube or the auxiliary tube with the control valve. The fire bridge is connected between the mixing tube and the auxiliary tube. Multiple orifices are defined in the top of the fire bridge. With such a burner, the flames can be switched between the side tube and the auxiliary tube. With a diameter of the auxiliary tube being smaller than that of the mixing tube, the small quantity of gas can evenly spread in the auxiliary tube and the flame on the auxiliary tube will not go out even when the gas pressure is low. Therefore, the burner can provide a reliable low level heat function and a wide range heat output performance Other objects, advantages and novel features of the invention will become more apparent from the following detailed description when taken in conjunction with the accompanying drawings.

DETAILED DESCRIPTION OF PREFERRED EMBODIMENT

Figure 1:
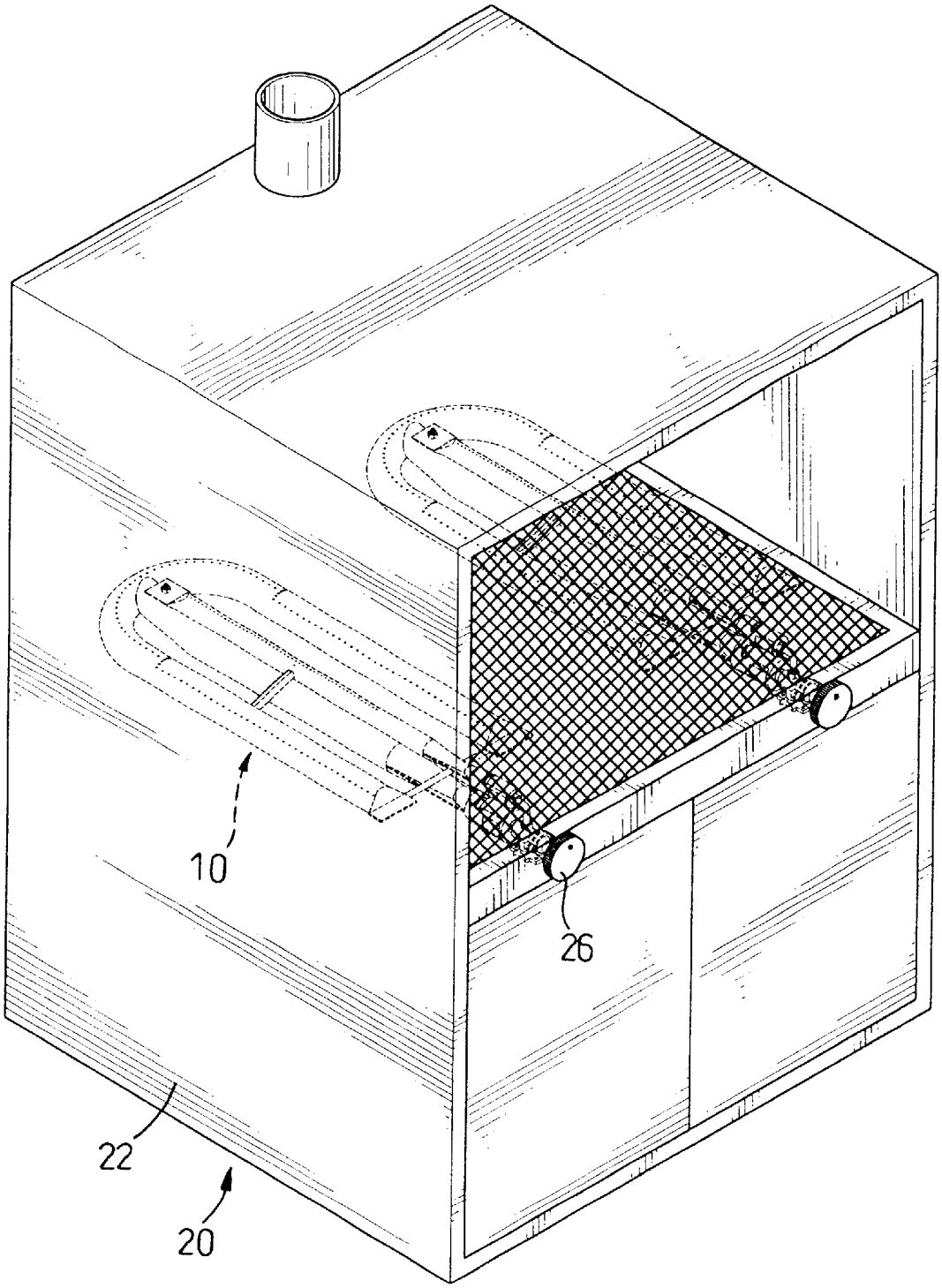
FIG. 1 is a perspective view of a gas barbecue grill with burners in accordance with the present invention.
Figure 2:
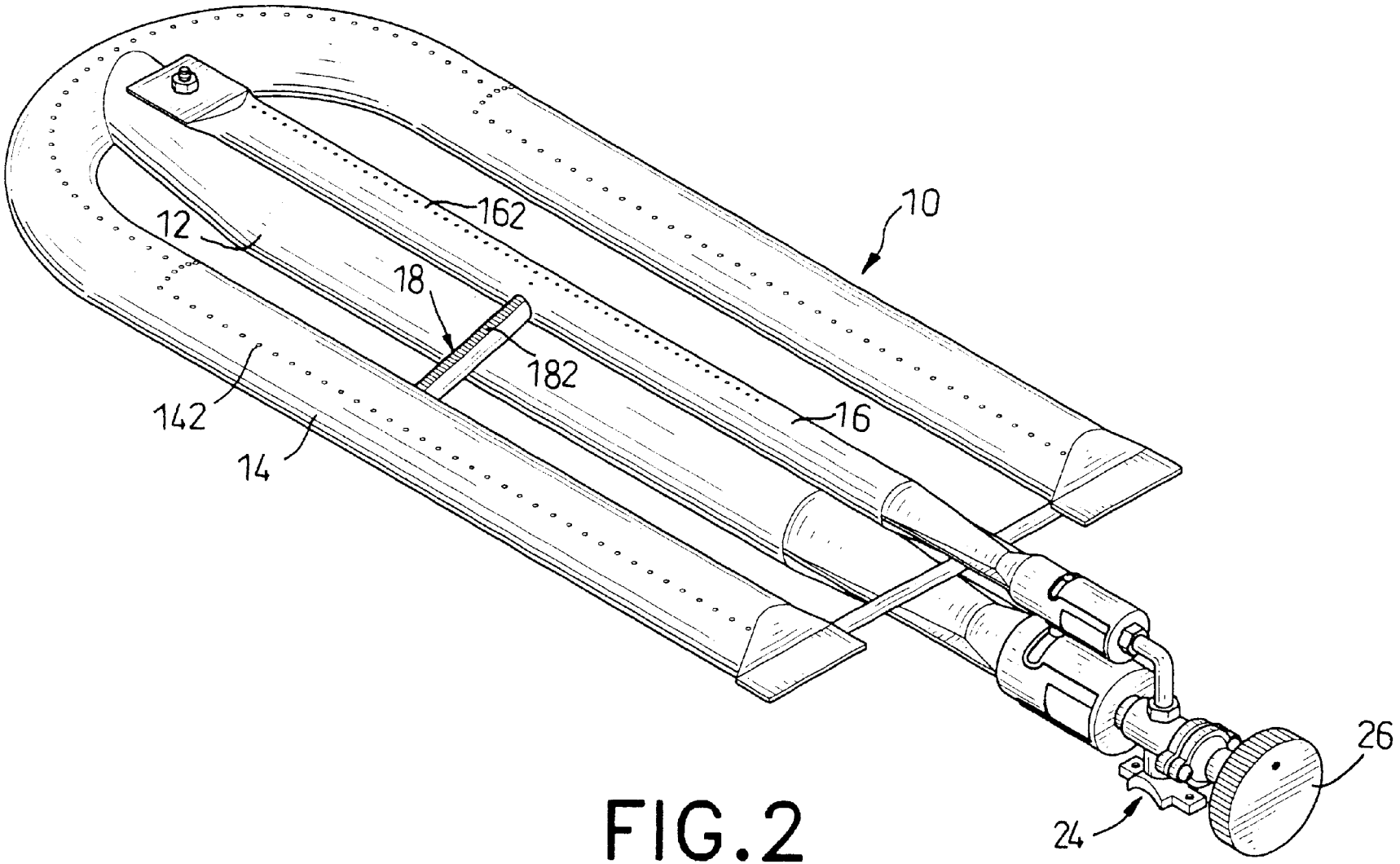
FIG. 2 is a perspective view of the burner in FIG. 1.

With reference to FIGS. 1 and 2, a burner (10) for a gas barbecue grill (20) in accordance with the present invention comprises a mixing tube (12), a side tube (14), an auxiliary tube (16) and a fire bridge (18). The burner (10) is secured in a housing (22) of the barbecue grill (20) for heating or cooking food. The mixing tube (12) is secured in the housing (22) and connected to a control valve (24) at one end of the mixing tube (12). Wherein the control valve (24) is connected to a gas source with a hose (not shown), such that the gas can be led into the mixing tube (12) through the hose and the control valve (24). The control valve (24) can be a mechanism valve or an electrical valve. An adjusting knob (26) is attached to the control valve (24) to adjust the passage in the control valve (24) communicating with the mixing tube (12). A vent (not numbered) is defined in the mixing tube (12) near the control valve (24), such that the air can enter the mixing tube (12) to mix with the gas for assisting the burning of the gas.

The side tube (14) is U-shaped and is connected to the other end of the mixing tube (12) at a middle portion of the side tube (14). The side tube (14) communicates with the mixing tube (12) and has multiple orifices (142) defined in the top of the side tube (14). Consequently, the gas can be led into the mixing tube (12) and the side tube (14) and is emitted from the orifices (142) in the side tube (14).

The auxiliary tube (16) is mounted above the mixing tube (12) and is connected to the control valve (24), such that the gas can be led into the mixing tube (12) or the auxiliary tube (16) by the control valve (24). The auxiliary tube (16) has a diameter smaller than that of the mixing tube (12). Multiple orifices (162) are defined in the top of the auxiliary tube (16). A vent (not numbered) is defined in the auxiliary tube (16) near the control valve (24), such that the air can enter the auxiliary tube (16) to mix with the gas for assisting the burning of the gas.

The fire bridge (18) is communicated between the side tube (14) and the auxiliary tube (16). Multiple orifices (182) are defined in the top of the fire bridge (18).

Figure 3:
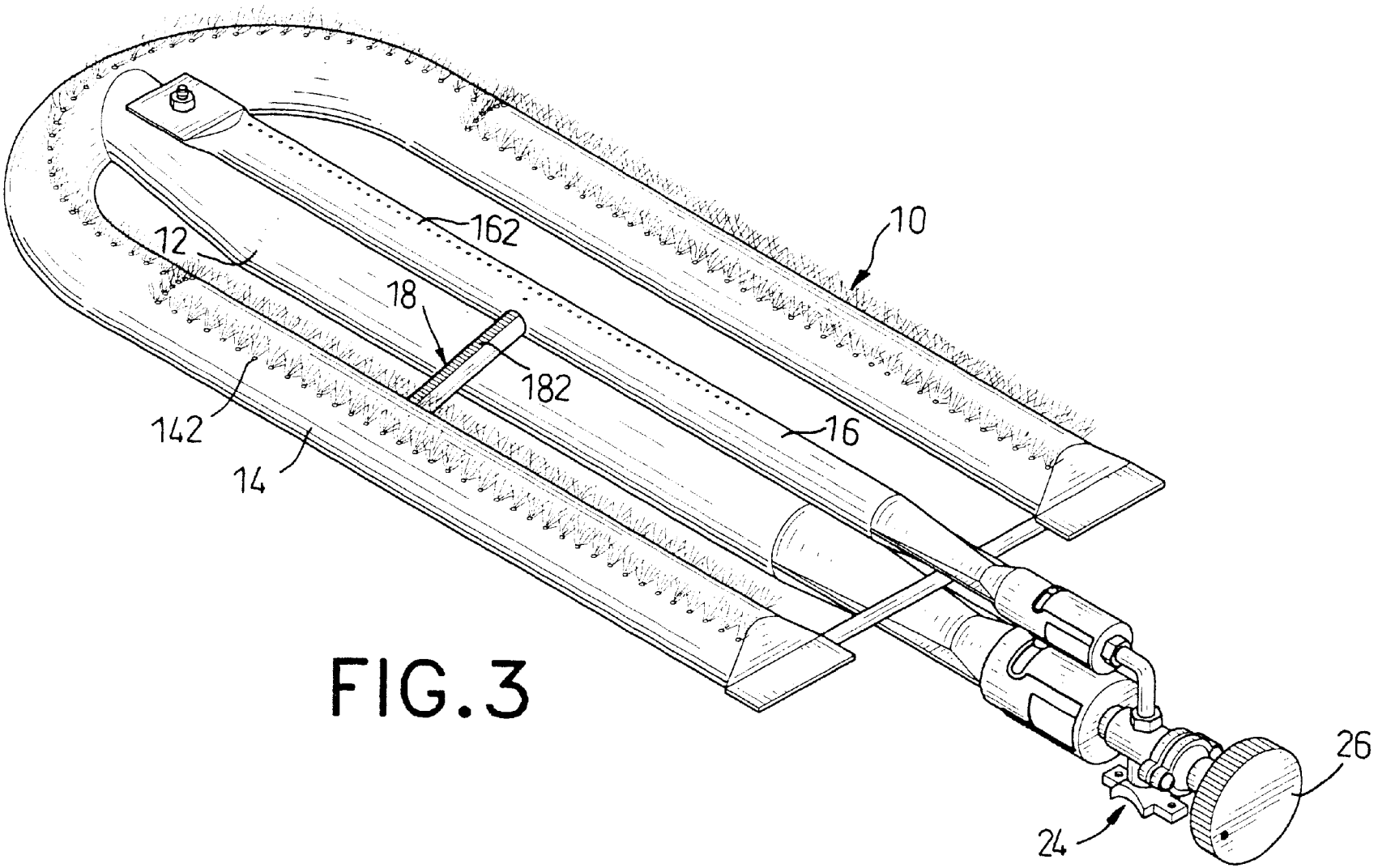
FIG. 3 is an operational perspective view of the burner in FIG. 1 showing that a large flame is on the side tube.

When the user wants to heat or to cook food, with reference to FIG. 3, the user turns the adjusting knob (26) to control a large quantity of gas to be entirely led into the mixing tube (12) with the control valve (24). After igniting, the gas sprayed from the orifices (142) in the side tube (14) will burn and flames will occur on the side tube (14). The flames will be controlled by turning the adjusting knob (26) to adjust the size of the passage in the control valve (24) for the gas passing therethrough.

Figure 4:
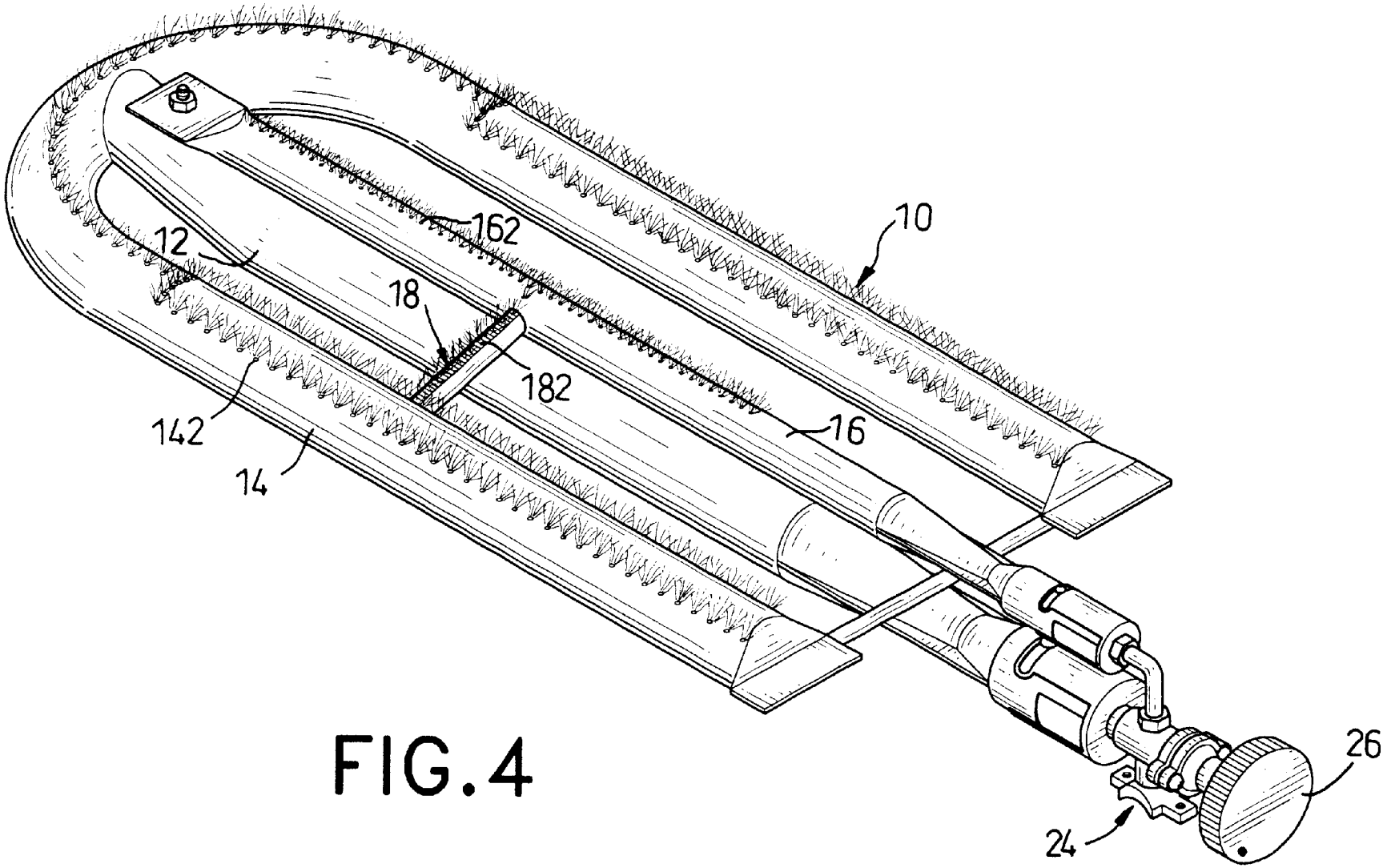
FIG. 4 is an operational perspective view of the burner in FIG. 1 showing that both side tube and auxiliary tube has flames thereon.
Figure 5:
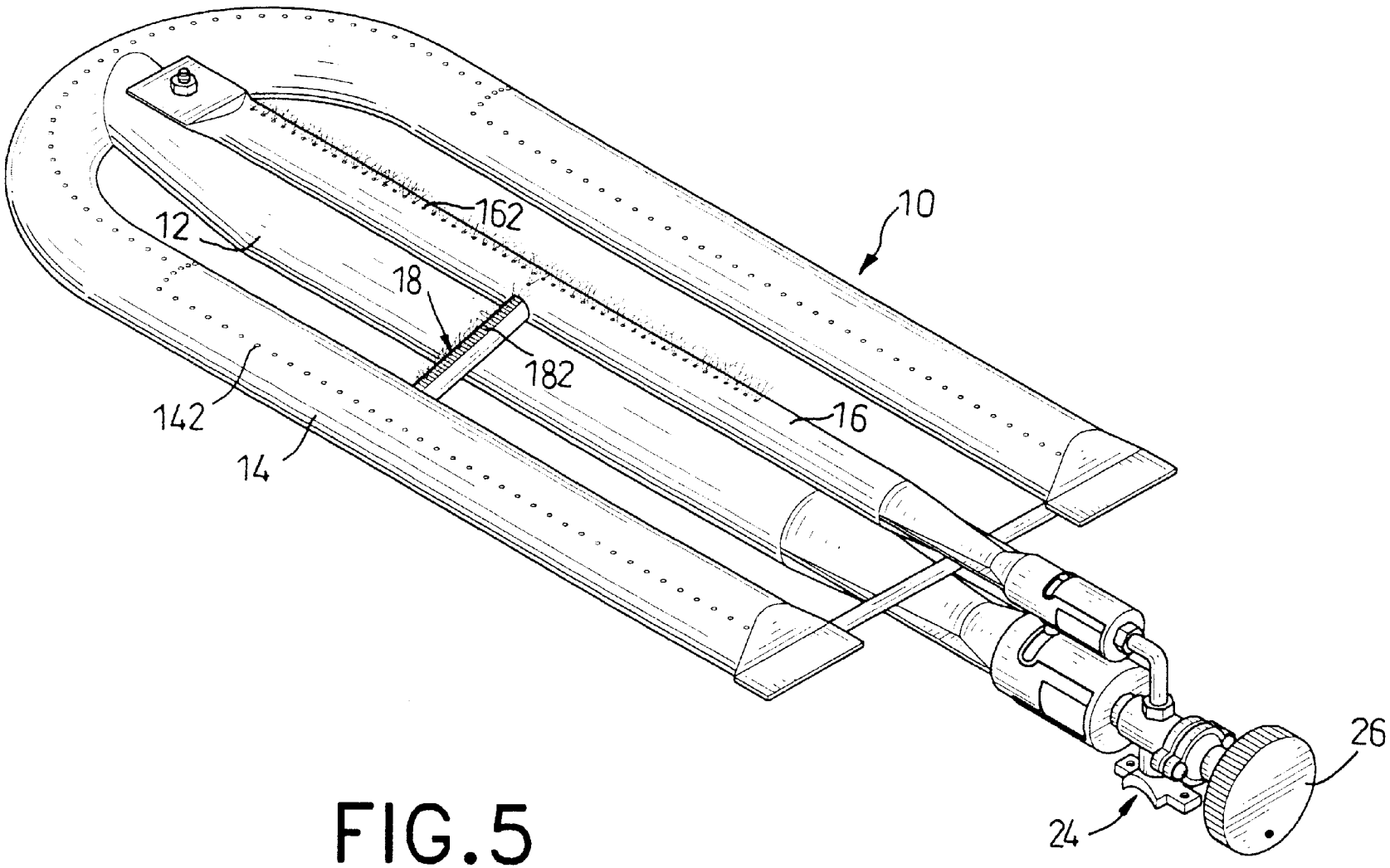
FIG. 5 is an operational perspective view of the burner in FIG. 1 showing that a small flame is on the auxiliary tube.
Figure 6:
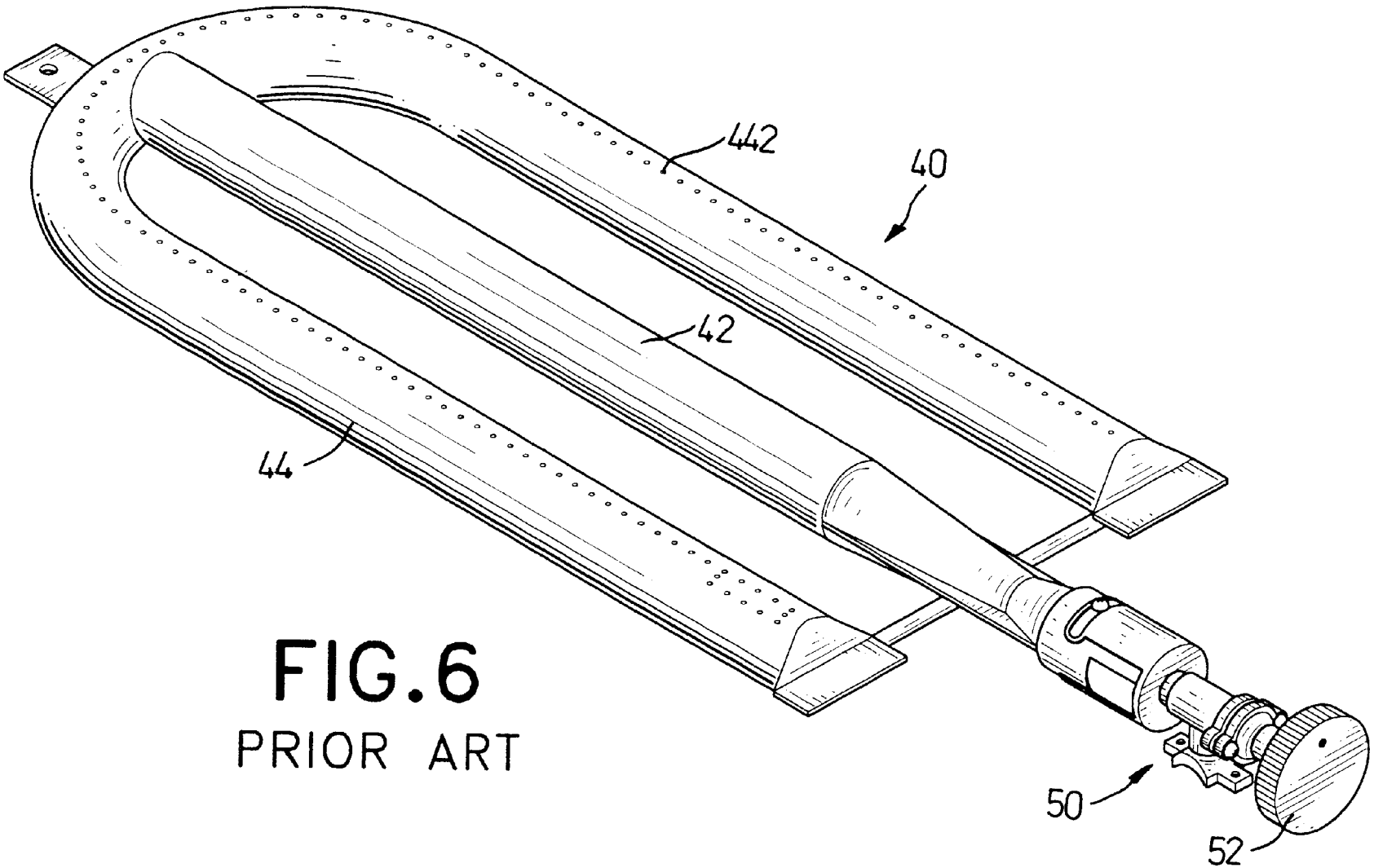
FIG. 6 PRIOR ART
FIG. 6 is a perspective view of a conventional burner in accordance with the prior art.

When the user just wants to keep warm to the food, with reference to FIGS. 4 and 5, the adjusting knob (26) is turned to reduce the passage in the control valve (24) communicating to the mixing tube (12) and to open the passage in the control valve (24) communicating to the auxiliary tube (16). Consequently, the gas will be led into the auxiliary tube (16). Before the gas is entirely led into the auxiliary tube, (16) the gas will be simultaneously led into the mixing tube (12) and the auxiliary tube (16) so that the flames on the side tube (14) will keep burning. Therefore, the gas will spread into the fire bridge (18) and is emitted from the orifices (182) in the fire bridge (18). The flame on the side tube (14) will ignite the gas emitted from the orifices (182) in the fire bridge (18), and flame on the fire bridge (18) will ignite the gas emitted from the orifices (162) in the auxiliary tube (16). Consequently, when the control valve (24) is switched to lead the entire gas into the auxiliary tube (16), flames will occur on the auxiliary tube (16) for the user to keep the food warm. Because the diameter of the auxiliary tube (16) is smaller than that of the mixing tube (12), a small quantity of gas can also evenly spread in the auxiliary tube (16). Therefore, the flame on the auxiliary tube (16) will not go out even when a small quantity of gas is led into the auxiliary tube (16). An excellent low level warmth effect is provided, this can enlarge of the range of heat output performance of the burner (10). In addition, the safety of using the burner (10) is improved.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A burner for a gas barbecue grill comprising:

a mixing tube adapted to be connected to a control valve at a first end of the mixing tube;

a U-shaped side tube secured to a second end of the mixing tube and communicating with the mixing tube, the side tube having multiple orifices defined in a top of the side tube;

an auxiliary tube mounted above the mixing tube and adapted to be connected to the control valve connected to the mixing tube, the auxiliary tube having multiple orifices defined in a top of the auxiliary tube; and a fire bridge communicated between the mixing tube and auxiliary tube and having multiple orifices defined in a top of the fire bridge, wherein the diameter of the auxiliary tube is smaller than that of the mixing tube.

2. The burner as claimed in claim 1, wherein the mixing tube has a vent defined in the mixing tube at a position near the control valve for the air entering the mixing tube.

3. The burner as claimed in claim 1, wherein the auxiliary tube has a vent defined in the auxiliary tube at a position near the control valve for the air entering the auxiliary tube.

* * * * *